US005979135A

United States Patent [19]

Reeves

[11] Patent Number: 5,979,135

[45] Date of Patent: Nov. 9, 1999

[54] SIDING PANEL WITH FABRIC TAPE ATTACHMENT

[75] Inventor: Jerome K. Reeves, Flowery Branch, Ga.

[73] Assignee: CertainTeed Corporation, Valley Forge, Pa.

[21] Appl. No.: 08/927,156

[22] Filed: Sep. 11, 1997

[51] Int. Cl.[6] ..... E04D 2/20; E04D 2/30

[52] U.S. Cl. ..... 52/529; 52/798.1; 52/801.1; 139/50; 139/383 R; 428/192

[58] Field of Search ..... 52/309.1, 309.13, 52/529, 798.1, 801.1, 520, 543, 747.1, 748.1; 139/50, 383 R; 428/115, 192, 193

[56] References Cited

U.S. PATENT DOCUMENTS

| | | | |
|---|---|---|---|
| 3,295,264 | 1/1967 | Olson | 52/309.1 X |
| 3,984,269 | 10/1976 | Schneller et al. | 156/71 |
| 4,384,021 | 5/1983 | Aoyama | 428/193 |
| 4,580,389 | 4/1986 | Freiborg | 52/748.1 |
| 5,037,685 | 8/1991 | Richards et al. | 52/518 X |
| 5,240,756 | 8/1993 | Finell et al. | 428/193 X |
| 5,526,627 | 6/1996 | Beck | 52/519 |
| 5,729,946 | 3/1998 | Beck | 52/520 |
| 5,768,844 | 6/1998 | Grace, Sr. et al. | 52/529 |
| 5,857,303 | 1/1999 | Beck et al. | 52/543 X |
| 5,887,403 | 3/1999 | Beck | 52/543 X |

*Primary Examiner*—Carl D. Friedman
*Assistant Examiner*—Timothy B. Kang
*Attorney, Agent, or Firm*—Paul & Paul

[57] ABSTRACT

An improved siding panel for covering an exterior portion of a structure includes a fabric attached to an edge thereof and a siding nail coupling the fabric to the exterior. The fabric is formed of monofilament polyester yarn, with the warp yarn woven into a solid band and the weft yarn woven to form a series of loops beneath the solid band. The weft yarn loops are laminated into the top edge of the siding panel. The siding nail is then securely nailed into the solid band of yarn.

8 Claims, 1 Drawing Sheet

SIDING PANEL WITH FABRIC TAPE ATTACHMENT

BACKGROUND OF THE INVENTION

1. Field of the Invention

The present invention is directed to an improved siding panel and, more particularly, to a vinyl siding panel having a fabric attached to its upper edge for nailing to a house or other structure.

2. Background

The use of siding is quite popular as an exterior for homes, dwelling, and commercial buildings. Siding is usually less expensive than brick and often provides excellent insulation. In addition, over a long period of time, siding can be more energy-efficient than brick or natural wood exteriors.

A home buyer has an array of sidings from which to choose. Wood board and batten siding consists of staggered wood siding members nailed to the exterior of the home. Similarly, aluminum siding consists of overlapping aluminum panels attached to the home with adhesive or nails. Vinyl siding, often considered more aesthetically pleasing than aluminum siding, is produced in elongated strips or panels which are nailed or otherwise secured to the house along one of their longitudinal edges. The opposing longitudinal edge overlaps and interlocks with the panel positioned immediately beneath it. In this manner, the installer commences the installation near the foundation and works his way up to the roof line.

Vinyl siding must be carefully installed to prevent damage to the siding during installation or later problems. During installation, the installer must avoid an errant hammer blow to the siding and must not puncture the siding with a nail or seat the siding nails tight against the panel or, worse, to a flush position distorting the vinyl under the nail head. Instead, nail slots are punched into the siding panels during manufacture. The installer drives each nail into a slot in the panel using a conventional hammer. The nail must secure the panel, but provide sufficient "play" for the panel to thermally expand and contract. If nailed too tightly against the frame, the siding will buckle and have an unattractive appearance.

Power screw drivers and nail or staple guns cannot install fasteners with the accuracy necessary to ensure that the siding nail or other fastener is properly seated. Accordingly, skilled workers are required to install vinyl siding, and doing so is very time-consuming. Moreover, the per-hour cost of skilled labor can be very high, resulting in high installation costs.

SUMMARY OF THE INVENTION

The present invention overcomes the problems of the prior art by attaching or laminating a fabric tape to an upper edge of the siding panel. The fabric is composed of a high-strength material, preferably a chemically-stabilized monofilament polyester or similar material that can withstand the high-temperatures associated with the lamination process. The warp of the fabric includes a plurality of yarns woven into a solid band. The weft yarns extend through the solid band and into the siding panel. To increase the strength of the fabric, the weft yarns within the panel form a plurality of loops. The panel is installed by nailing the solid band of yarn to the exterior of the structure, with the solid portion of the panel hanging below the solid band of fabric. The vinyl panel may then expand and contract without buckling. Moreover, the improved siding panel may be machine-nailed, screwed or stapled to the structure, thus reducing the time and expense normally associated with siding installation.

Objects and advantages of the invention are described below and are obvious from that description or from practice of the invention. Those objects and advantages will be realized by practice of the elements and combinations particularly identified in the appended claims.

DETAILED DESCRIPTION OF THE INVENTION

Reference will now be made in detail to the invention, examples of which are illustrated in the accompanying drawings. Wherever possible, the same reference numbers will be used throughout the drawings to refer to the same or like parts.

Figure 1:
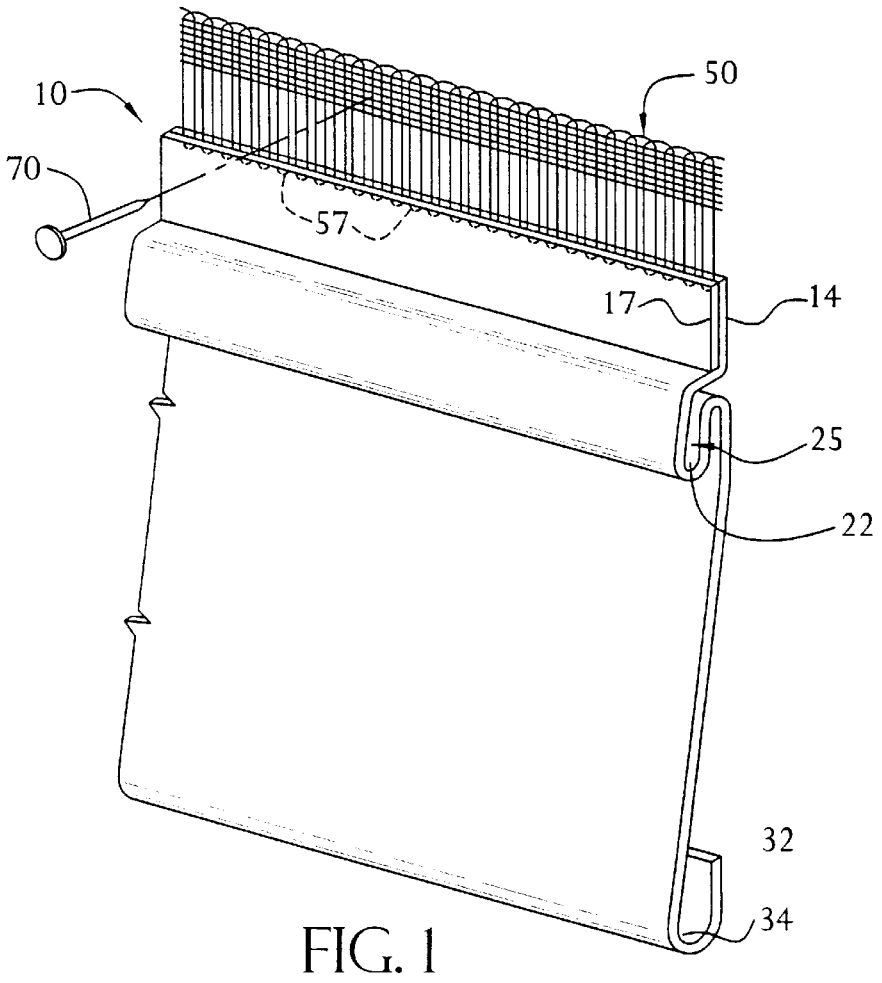
FIG. 1 is a perspective view of an improved siding panel of the present invention.

FIG. 1 is a perspective view of a siding panel of the present invention. A typical piece of siding is an elongated vinyl sheet that is manufactured to resemble one or two rows of wood siding or clapboard. The illustrative siding panel 10 shown in FIG. 1 is designed to resemble one board of wood siding. Siding panel 10 includes a planar upper edge 14 that is designed to lie adjacent the outer wall or other structure on which it is being installed. From upper edge 14, siding panel 10 extends downwardly forming a loop 22 immediately below upper edge 14. This loop forms a channel 25 which extends for the length of the panel and is referred to in the trade as the top lock. Siding panel 10 then extends downwardly and slightly outward until it forms a hook-like member 32 and longitudinal channel 34 which extends for the length of the lower edge of siding panel 10. The hook member 32 and channel portion 34 are designed to engage the top lock portion formed by loop 22 and channel 25 of the siding panel located immediately below the panel described. Lower hook member 32 is of the same thickness as the remainder of the siding panel 10 and is designed to be in contact with an upper portion of loop 22.

To secure siding panel 10 to the structure or foundation, a fabric tape 50 is laminated into upper edge 14 during manufacture of the panel 10. For instance, the panel 10 may be manufactured by passing a flat vinyl piece through a pressing mold. The mold creates the curvatures of the panel 10 as shown in FIG. 1 Once the solid portion of the panel is formed, an end of the fabric tape 50 is placed between the upper edge 14 and second longitudinal member 17. The longitudinal member 17, the fabric 50, and the upper edge 14 are then laminated together using a high-temperature laminating press.

During installation, a siding nail 70, or other fastener such as a staple or screw is inserted through an upper portion of the tape fabric 50 and into the wall or other structure.

Figure 2:
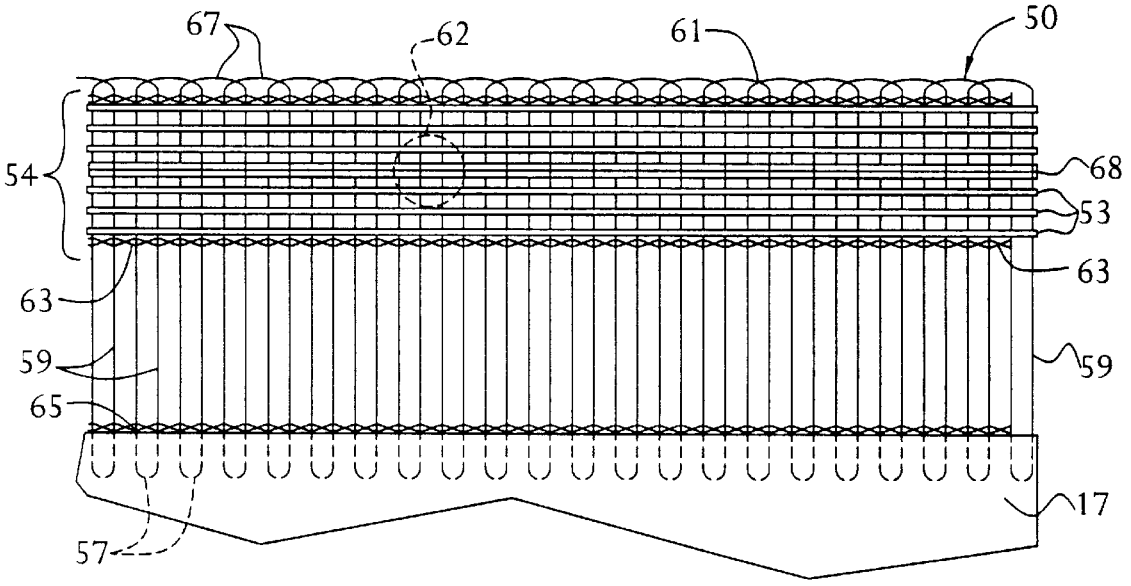
FIG. 2 is a front view of the tape of the present invention.

Tape fabric 50 is shown in greater detail in FIG. 2. FIG. 2 is an enlarged front view of fabric 50 and a portion of longitudinal member 17. Fabric tape 50 includes a plurality of chemically-stabilized monofilament polyester longitudinal warp yarns 53 woven into a solid band portion 54. Monofilament polyesters usable in accordance with the present invention include the material sold under the trademark Trevira Polyester Monofilament by Hoechst Celanese. The warp yarns 53 have an oval cross-section and are typically approximately 1900 denier. The yarns 53 are woven at 23 ends per ½ inch, although fewer yarns are illustrated in FIG. 2 for purposes of clarity. The solid band portion 54 is typically approximately one-half inch in height.

A weft or "fill" yarn 59 of chemically-stabilized monofilament polyester is woven square to the solid band portion 54 to form parallel loops 57 near the bottom of the fabric 50. The weft yarns 59 are locking stitched above the solid band portion 54. The weft yarns 59 have a round cross-section and are typically approximately 500 denier. The weft yarns 59 are woven at 24 ends per inch, although fewer yarns are illustrated in FIG. 2 for purposes of clarity. The loops 57 are typically approximately ⅞ inch in height, measuring from the bottom of the solid band portion 54 to the end of the loop 57.

To increase the strength of the loops 57, a plurality of yarns 61, 63, 65 may be leno-stitched longitudinally across the tape fabric 50. The leno stitches are formed by longitudinally intertwining two pieces of yarn through the loops 57. Alternatively, two yarns may be sewn between the loops 57 and the yarns 53 of the solid band portion 54. The leno yarns 61, 63, 65 are chemically-stabilized monofilament polyester yarns having a round cross-section. The yarns 61, 63, 65 are typically approximately 500 denier. In FIG. 2, leno stitch 61 is located 1/16 inch above the top warp yarn 53. Leno stitch 63 is located directly beneath the bottom warp yarn 53. Leno stitch 65 is located ⅛ inch above the bottom of loop 57. It should be apparent, however, that the leno stitches may be located in other portions of the fabric 50, as well.

As discussed above, the fabric 50 may be attached by capturing loops 57 between upper edge 14 of the siding panel 10 and longitudinal member 17. This leaves the vinyl panel hanging from band 54 by weft yarn 59. The solid band portion 54 may include two ends of nail guide warp yarn 68 in a color that contrasts with the other warp yarns 53 to indicate where fasteners should be placed. The nail guide yarn 68 may be formed of polypropylene or a similar material. In addition, a specific securing mark 62 may be used to indicate fastener spacing.

The siding panel 10 is affixed by driving a siding nail 70 or other fastener through the tape fabric into the wall or other structure. A second panel is added by securing a bottom hook portion 32 and channel 34 of the second panel, to the upper edge 12 of the previously-installed panel beneath it. The second panel is then secured by nailing a siding nail through its tape fabric 50. This process continues upward until the upper edge 14 of the top side panel 10 meets the roof line of the structure.

Having thus described a preferred embodiment of a method and fabric for installing vinyl siding, it should be apparent to those skilled in the art that certain advantages have been achieved. It should also be appreciated that various modifications, adaptations, and alternative embodiments thereof, including the addition of a second nail-indicating warp, for example, may be made within the scope and spirit of the present invention. The invention is further defined by the following claims:

What is claimed is:

1. A siding panel comprising:

a vinyl sheet having an upper edge; and a fabric tape affixed to the upper edge of the vinyl sheet, wherein the fabric further comprises:

a plurality of longitudinal warp yarns; and at least one weft yarn woven through the warp yarns to form a relatively solid band having two edges and a plurality of loops extending from one edge of the band.

2. The siding panel of claim 1, further comprising at least one leno stitch sewn through the plurality of loops.

3. The siding panel of claim 2, wherein the fabric is affixed to the edge of the siding panel.

4. The fabric tape, as recited in claim 2, wherein one of the plurality of leno stitches is positioned proximate the edge of the siding panel.

5. A fabric tape for attachment to an edge of a vinyl siding panel, the fabric tape comprising:

a plurality of monofilament polyester warp yarns positioned side-by-side; and at least one monofilament polyester weft yarn woven through the warp yarns to form a relatively solid band having two edges and a plurality of loops extending from one of the edges.

6. The fabric tape of claim 6, further comprising a plurality of leno stitches sewn through the loops.

7. A method for installing a vinyl siding panel on a structure, the method comprising the steps of:

providing a monofilament polyester fabric tape on an edge of the siding panel; and coupling the tape to the structure, wherein the monofilament polyester tape further comprises:

a plurality of monofilament polyester warp threads positioned side-by-side; and a monofilament polyester weft thread through the warp threads woven forming a plurality of loops extending from an edge solid band portion forming a relatively solid band having an edge with a plurality of loops extending from the edge.

8. A method for installing a vinyl siding panel on a structure, the method comprising the steps of:

providing a monofilament polyester fabric tape on an edge of the siding panel; and coupling the tape to the structure, further the tape comprising leno stitched plurality of monofilament threads through the plurality of loops.

* * * * *